US008925684B1

(12) United States Patent
Medina

(10) Patent No.: US 8,925,684 B1
(45) Date of Patent: Jan. 6, 2015

(54) LADDER SHELF SYSTEM

(71) Applicant: Michael Frank Medina, North Hollywood, CA (US)

(72) Inventor: Michael Frank Medina, North Hollywood, CA (US)

( * ) Notice: Subject to any disclaimer, the term of this patent is extended or adjusted under 35 U.S.C. 154(b) by 0 days.

(21) Appl. No.: 13/670,740

(22) Filed: Nov. 7, 2012

(51) Int. Cl.
*E06C 7/14* (2006.01)
*E06C 7/16* (2006.01)

(52) U.S. Cl.
USPC ..... 182/129; 182/115; 182/120; 248/238

(58) Field of Classification Search
CPC ..... E06C 7/14; E06C 7/16; E06C 7/165
USPC ..... 182/129, 90, 92, 120–122, 115, 116, 182/125, 126, 53, 54, 56, 222; 248/238, 248/210, 211
See application file for complete search history.

(56) References Cited

U.S. PATENT DOCUMENTS

| | | | | | |
|---|---|---|---|---|---|
| 712,351 | A | * | 10/1902 | Adkins | 182/173 |
| 1,113,436 | A | * | 10/1914 | Hartzler | 182/216 |
| 1,992,391 | A | * | 2/1935 | Pease | 182/125 |
| 2,166,255 | A | * | 7/1939 | Ligon | 182/126 |
| 2,308,180 | A | * | 1/1943 | Larsen et al. | 248/238 |
| 2,473,951 | A | * | 6/1949 | Hickey | 182/120 |
| 2,478,592 | A | * | 8/1949 | Nyberg | 182/125 |
| 2,481,581 | A | * | 9/1949 | Ehnhuus | 182/174 |
| 2,882,003 | A | * | 4/1959 | Stiffler | 248/238 |
| 3,083,786 | A | * | 4/1963 | Arnold | 182/126 |
| 3,106,987 | A | * | 10/1963 | Lerner | 182/126 |
| 3,422,923 | A | * | 1/1969 | Lund | 182/120 |
| 3,812,932 | A | * | 5/1974 | Davis | 182/126 |
| 4,261,435 | A | * | 4/1981 | Winter | 182/129 |
| 4,460,063 | A | * | 7/1984 | Casada | 182/116 |
| 4,703,833 | A | * | 11/1987 | Bachman | 182/129 |
| 4,721,319 | A | * | 1/1988 | Dale | 280/169 |
| 4,949,925 | A | | 8/1990 | Gorecki | |
| 4,979,590 | A | * | 12/1990 | Bailey | 182/106 |
| 5,058,707 | A | * | 10/1991 | Waid | 182/120 |
| 5,098,052 | A | * | 3/1992 | Beck | 248/238 |
| D340,291 | S | | 10/1993 | Bartnicki et al. | |
| D372,990 | S | * | 8/1996 | Sweeney | D25/68 |
| 5,715,909 | A | * | 2/1998 | Gagnon | 182/173 |

(Continued)

OTHER PUBLICATIONS

Definition of 'surface' provided in Allowability Notice The American Heritage® Dictionary of the English Language, Fourth Edition copyright ©2000 by Houghton Mifflin Company. Updated in 2009. Published by Houghton Mifflin Company. All rights reserved.*

(Continued)

*Primary Examiner* — Daniel Cahn

(57) ABSTRACT

The present invention features a ladder shelf system for adding a generally planar rectangular shelf close to the top of a step ladder. The system has the generally planar rectangular shelf that is rigid with a step engagement member located on a shelf top surface. The step engagement member is adapted to fit inside an interior cavity of a top step of a step ladder. The system has a generally planar rectangular non-slip pad centrally located on the shelf top surface. The system has a locking lever located close to the shelf posterior end. In a first unlocked position, a first clamping member and a second clamping member lie on a plane perpendicular to the shelf top surface. In a second locked position, the first clamping member and the second clamping member lie on a plane parallel with the shelf top surface.

5 Claims, 4 Drawing Sheets

(56) References Cited

U.S. PATENT DOCUMENTS

| | | | | |
|---|---|---|---|---|
| 5,873,433 | A * | 2/1999 | Katz | 182/129 |
| 6,131,699 | A * | 10/2000 | Leak, Jr. | 182/129 |
| 6,341,666 | B1 | 1/2002 | Allen | |
| 6,698,699 | B1 * | 3/2004 | Bailey | 248/210 |
| 7,032,711 | B1 * | 4/2006 | Katz et al. | 182/129 |
| 7,270,307 | B2 | 9/2007 | Zodnik | |
| 7,984,790 | B2 * | 7/2011 | Meyers et al. | 182/129 |
| 8,033,362 | B1 | 10/2011 | Cull | |
| 2001/0052437 | A1 | 12/2001 | MacSweeney et al. | |
| 2006/0137937 | A1 | 6/2006 | Pratt | |

OTHER PUBLICATIONS

Definition of 'boundary' provided in Allowability Notice The American Heritage® Dictionary of the English Language, Fourth Edition copyright ©2000 by Houghton Mifflin Company. Updated in 2009. Published by Houghton Mifflin Company. All rights reserved.*

* cited by examiner

LADDER SHELF SYSTEM

BACKGROUND OF THE INVENTION

Ladders have been in use for many centuries as supported by their depiction in a Mesolithic rock painting in the Spider Caves in Valencia, Spain. Modern ladders are thought to have been developed by the Hebrews and Egyptians during the expansion of their civilizations. There are many styles of ladders in common use today including the fixed ladder, the extension ladder, the folding ladder, the step ladder and many others. The present invention features a ladder shelf system for adding a usable storage shelf close to the top of a step ladder. This enables the user to have tools and supplies within reach without having to dismount the ladder.

SUMMARY

The present invention features a ladder shelf system for adding a usable storage shelf close to the top of a step ladder. In some embodiments, the system comprises a generally planar rectangular shelf that is rigid. In some embodiments, the system comprises a step engagement member located on a shelf top surface. In some embodiments, a step engagement member posterior side is located flush with a shelf posterior end. In some embodiments, the step engagement member is adapted to fit snuggly inside an interior cavity of a top step of a step ladder In some embodiments, the system comprises a generally planar rectangular non-slip pad centrally located on the shelf top surface. In some embodiments, the system comprises a locking lever located close to the shelf posterior end. In some embodiments, in a first unlocked position, a first clamping member and a second clamping member lie on a plane perpendicular to the shelf top surface. In some embodiments, in a second locked position, the first clamping member and the second clamping member lie on a plane parallel with the shelf top surface.

In some embodiments, the system comprises a recess located on the shelf top surface beneath a midpoint of a horizontal cross member when the locking lever is in the first unlocked position.

In some embodiments, the shelf bottom surface is positioned on a step ladder horizontal support. In some embodiments, the shelf engagement member is snugly located in the interior cavity of the top step of the step ladder. In some embodiments, the locking lever is moved to the second locked position. In some embodiments, the first clamping member and the second clamping member are moved to an exterior top surface of the top step of the step ladder. In some embodiments, the shelf on a step ladder horizontal support is supported in a generally level position.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
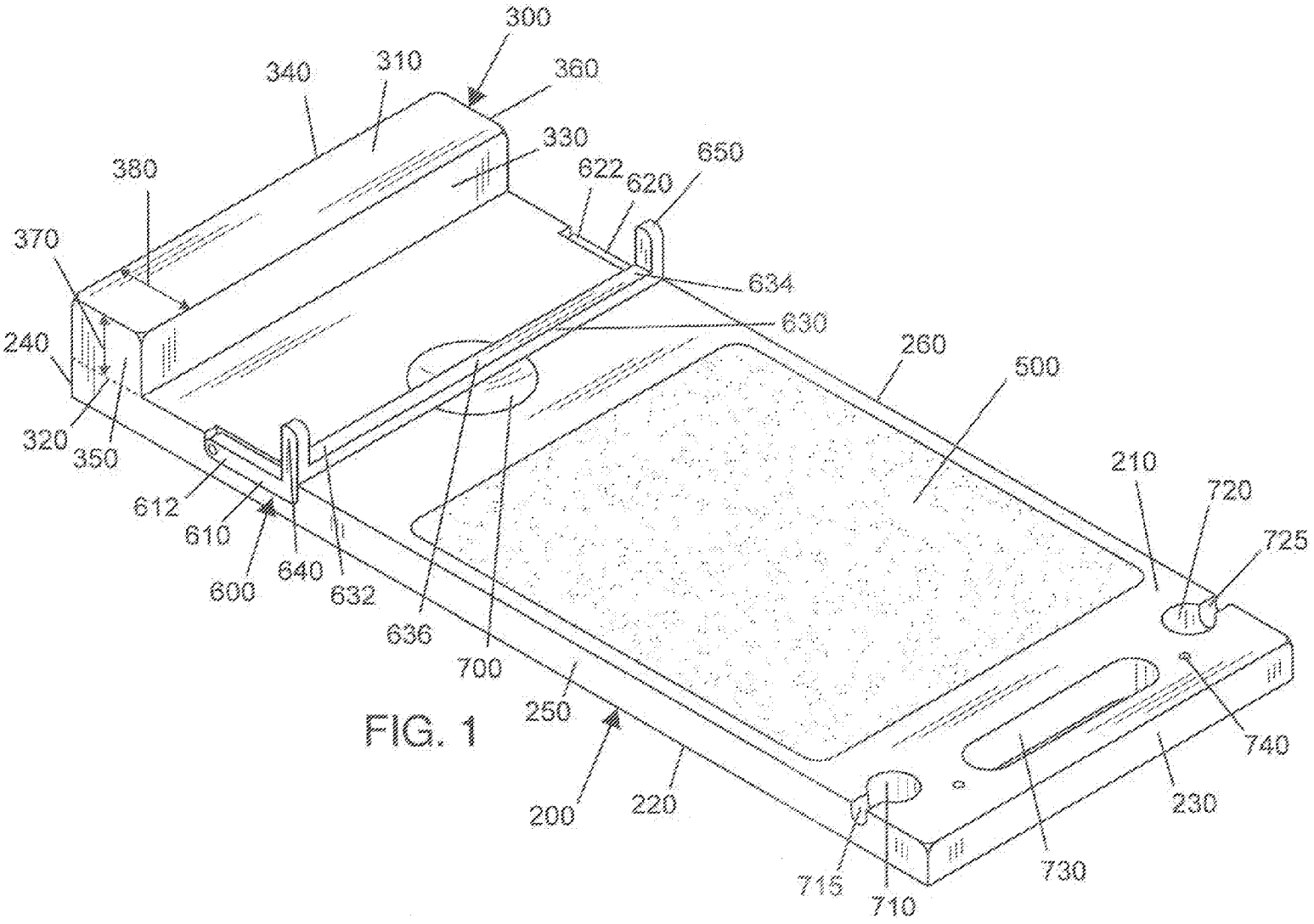
FIG 1 is a perspective view of the present invention.
Figure 2:
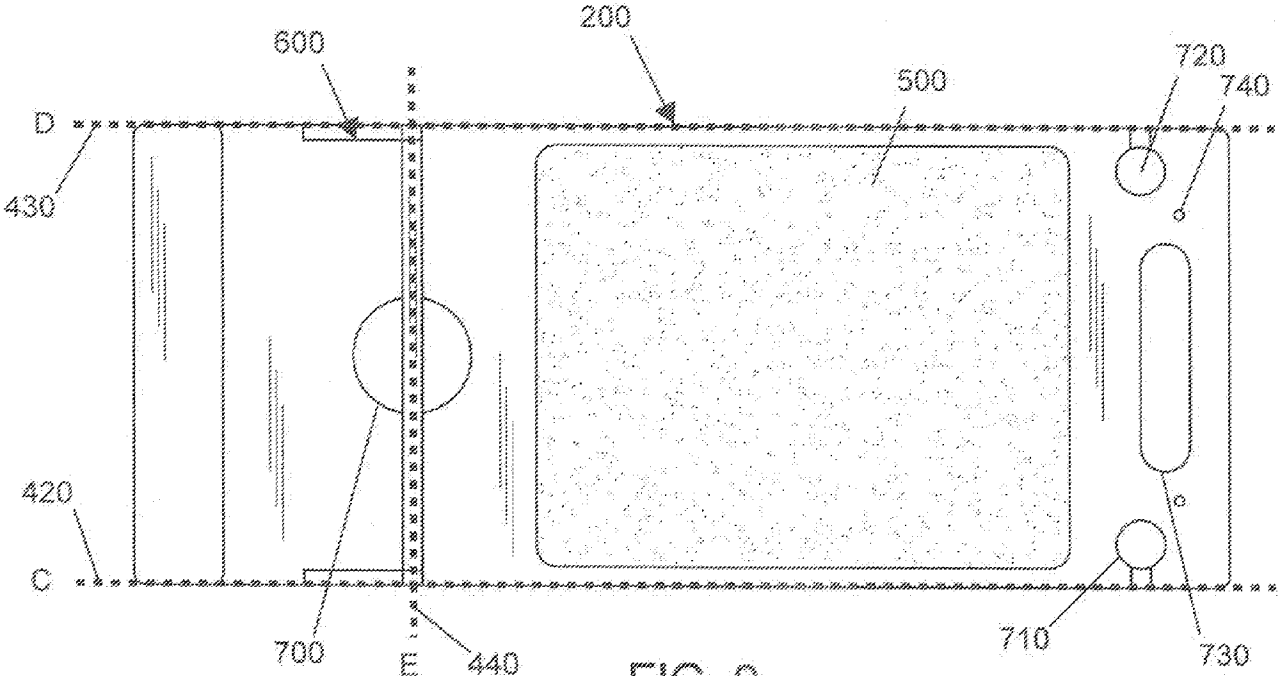
FIG. 2 is a top view of the present invention.
Figure 3:
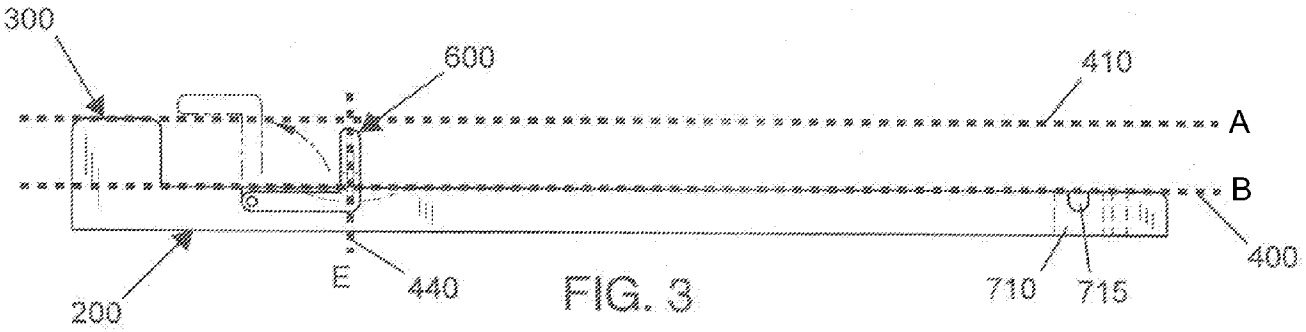
FIG. 3 is a side view of the present invention.
Figure 4:
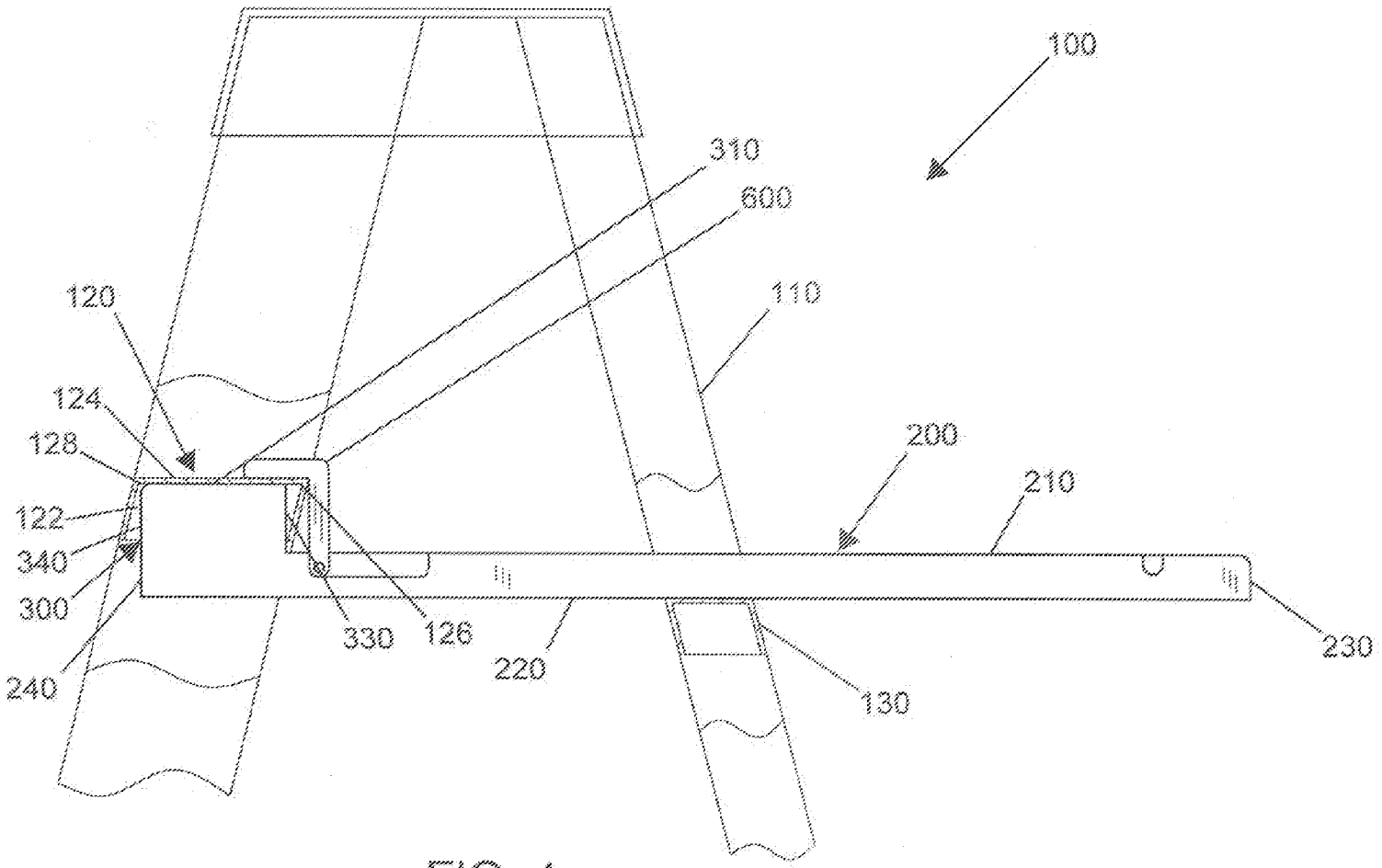
FIG. 4 is a side view of the present invention.
Figure 5:
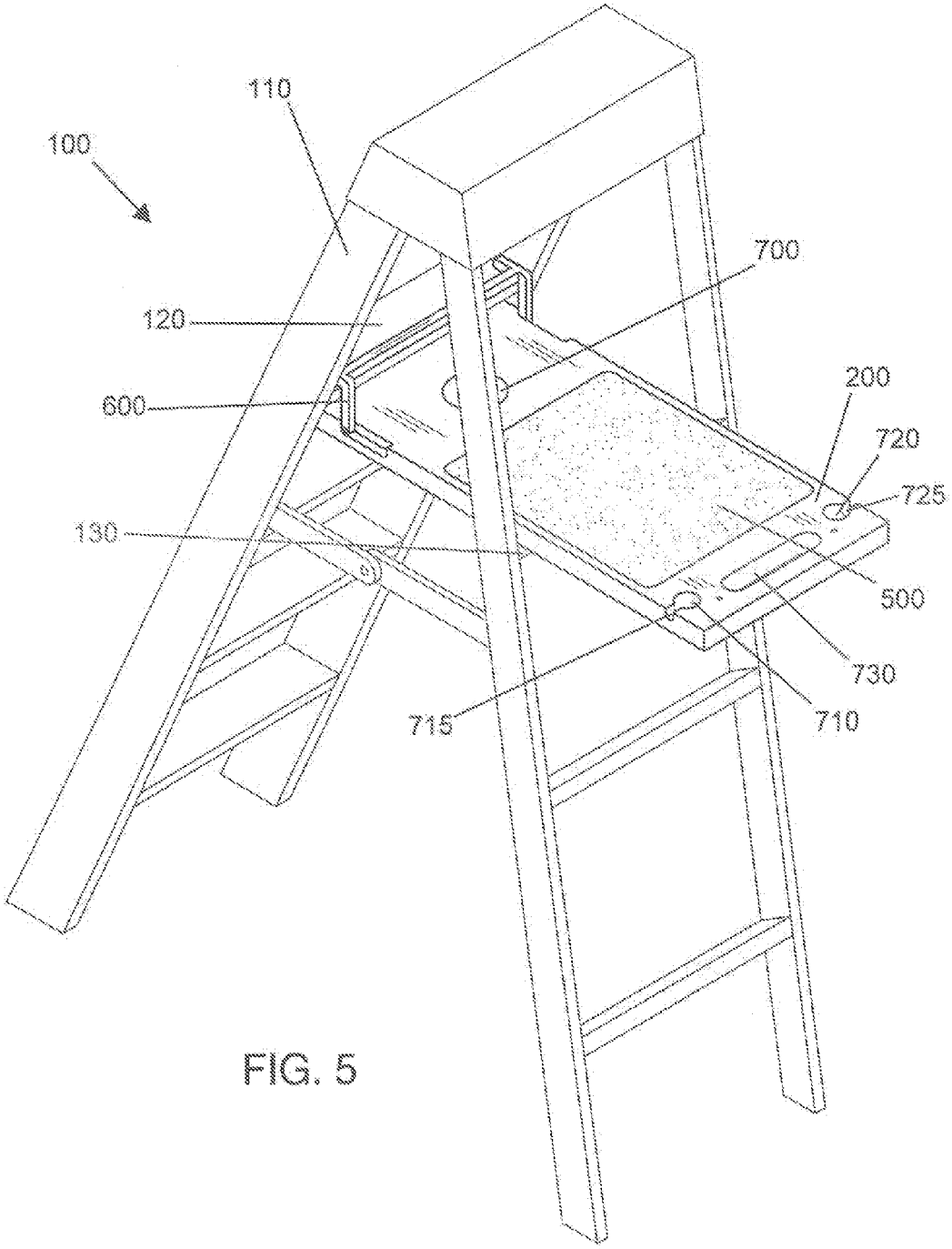
FIG 5 is a perspective view of the present invention.

Following is a list of elements corresponding to a particular element referred to herein:

100 Ladder shelf system
110 Step ladder
120 Step ladder top step
122 Top step interior cavity
24
124 Top step top surface
126 Top step anterior internal edge
128 Top step posterior internal edge
130 Step ladder horizontal support
200 Shelf
210 Shelf top surface
220 Shelf bottom surface
230 Shelf anterior end
240 Shelf posterior end
250 Shelf first side
260 Shelf second side
300 Step engagement member
310 Step engagement member top surface
320 Step engagement member bottom surface
330 Step engagement member anterior surface
340 Step engagement member posterior side
350 Step engagement member first side
360 Step engagement member second side
370 Step engagement member height
380 Step engagement member depth
400 Plane A
410 Plane B
420 Plane C
430 Plane D
440 Plane E
500 Non-slip pad
600 Locking lever
610 First leg
612 First leg terminating end
620 Second leg
622 Second leg terminating end
630 Horizontal cross member
632 Horizontal cross member first side
634 Horizontal cross member second side
636 Horizontal cross member midpoint
640 First clamping member
650 Second clamping member
700 Recess
710 First circular screwdriver holding aperture
715 First slot
720 Second circular screwdriver holding aperture
725 Second slot
730 Linear slot
740 Hole Referring now to FIG. 1-5, the present invention features a ladder shelf system (100) for adding a usable storage shelf (200) near the top of a step ladder (110). In some embodiments, the system (100) comprises a generally planar rectangular shelf (200) having a shelf top surface (210), a shelf bottom surface (220), a shelf anterior end (230), a shelf posterior end (240), a shelf first side (250), and a shelf second side (260). In some embodiments, the shelf (200) is generally rigid. In some embodiments, the shelf (200) is constructed from wood. In some embodiments, the shelf (200) is generally rigid. In some embodiments, the shelf (200) is constructed from metal. In some embodiments, the shelf (200) is generally rigid. In some embodiments, the shelf (200) is constructed from plastic.

In some embodiments, the system (100) comprises a step engagement member (300) located on the shelf top surface (210). In some embodiments, the step engagement member (300) comprises a step engagement member top surface (310), a step engagement member bottom surface (320), a step engagement member anterior side (330), a step engagement member posterior side (340), a step engagement member first side (350), and a step engagement member second side (360). In some embodiments, the step engagement member posterior side (340) is located flush with the shelf posterior end (240). In some embodiments, the step engagement member (300) traverses the shelf (200) from the shelf first side (250) to the shelf second side (260). In some embodiments, the step engagement member top surface (310) lies on a plane. Plane A (400), parallel to a plane, Plane B (410). In some embodiments, the shelf top surface (210) has upon Plane B (410).

In some embodiments, the step engagement member (300) comprises a step engagement member depth (380) from the step engagement member anterior side (330) to the step engagement member posterior side (340) equivalent to a depth of a top step interior cavity (122) from a top step anterior internal edge (126) to a top step posterior internal edge (128). In some embodiments, the step engagement member (300) is adapted to fit snuggly inside the top step interior cavity (122). In some embodiments, the step engagement member (300) comprises a step engagement member width from the step engagement member first side to the step engagement member second side equivalent to a width of a top step interior cavity from a top step first internal edge to a top step second internal edge. In some embodiments, the step engagement member (300) is adapted to fit snuggly inside the top step interior cavity (122).

In some embodiments, a step engagement member height (370) from the step engagement member top surface (310) to the step engagement member bottom surface (320) is adapted to position the shelf (200) horizontally in a generally level manner when the shelf bottom surface (220) is located on a step ladder horizontal support (130) when the shelf engagement member is snugly located in the top step interior cavity (122).

In some embodiments, the system (100) comprises a generally planar rectangular non-slip pad (500) centrally located on the shelf top surface (210). In some embodiments, the system (100) comprises a locking lever (600) located close to the shelf posterior end (240). In some embodiments, the locking lever (600) comprises a general shape of a "U" having a first leg (610) located thereon with a first leg terminating end (612), a second leg (620) located thereon with a second leg terminating end (622), and a horizontal cross member (630) connecting the first leg (610) and the second leg (620). In some embodiments, the first leg terminating end (612) is pivotally located on the shelf first side (250) close to the shelf posterior end (240). In some embodiments, the second leg terminating end (622) is pivotally located on the shelf second side (260) close to the shelf posterior end (240).

In some embodiments, the locking lever (600) comprises a first clamping member (640) located at an intersection of the first leg (610) and a horizontal cross member first side (632) of the horizontal cross member (630). In some embodiments, the shelf (200) comprises a second clamping member (650) located at an intersection of the second leg (620) and a horizontal cross member second side (634) of the horizontal cross member (630).

In some embodiments, the first clamping member (640) is located at a perpendicular angle to the first leg (610). In some embodiments, the first clamping member (640) lies on a same plane, Plane C (420), as the first leg (610). In some embodiments, the first clamping member (640) extends out and away from the horizontal cross member (630).

In some embodiments, the second clamping member (650) is located at a perpendicular angle to the second leg (620). In some embodiments, the second clamping member (650) lies on a same plane, Plane D (430), as the second leg (620). In some embodiments, the second clamping member (650) extends out and away from the horizontal cross member (630).

In some embodiments, in a first unlocked position, the first clamping member (640) and the second clamping member (650) lie on a plane perpendicular to the shelf top surface (210), Plane E (440). In some embodiments, in a second locked position, the first clamping member (640) and the second clamping member (650) lie on a plane along with the shelf top surface (210), Plane B (410).

In some embodiments, the system (100) comprises a recess (700) located on the shelf top surface (210) midway between the shelf first side (250) and the shelf second side (260) close to the shelf posterior end (240). In some embodiments, the recess (700) lies beneath a horizontal cross member midpoint (636) of the horizontal cross member (630) when the horizontal cross member (630) is in the first unlocked position. In some embodiments, the recess (700) is circular. In some embodiments, the recess (700) provides clearance for a user's fingers to grab the horizontal cross member (630) for positioning.

In some embodiments, the shelf bottom surface (220) is positioned on a top surface of a step ladder horizontal support (130). In some embodiments, the step engagement member (300) is snugly located in the top step interior cavity (122). In some embodiments, the locking lever (600) is moved to the second locked position where the first clamping member (640) and the second clamping member (650) are located on (clamped on) an exterior top step top surface (124). In some embodiments, the shelf (200) on a step ladder horizontal support (130) is in a generally level position.

In some embodiments, a first circular screwdriver holding aperture (710) is located on the shelf top surface (210) close to the shelf anterior end (230) and the shelf first side (250). In some embodiments, the first circular screwdriver holding aperture (710) traverses a cross-section of the rectangular shelf (200) from the shelf top surface (210) to the shelf bottom surface (220). In some embodiments, a second circular screwdriver holding aperture (720) is located on the shelf top surface (210) close to the shelf anterior end (230) and the shelf second side (250). In some embodiments, the second circular screwdriver holding aperture (720) traverses the cross-section of the rectangular shelf (200) from the shelf top surface (210) to the shelf bottom surface (220).

In some embodiments, a first slot (715) is located on the shelf first side (250) close to the shelf anterior end (230). In some embodiments, the first slot (715) traverses a cross-section of the rectangular shelf (200) from the shelf first side (250) to the first circular screwdriver holding aperture (710). In some embodiments, a second slot (725) is located on the shelf second side (260) close to the shelf anterior end (230). In some embodiments, the second slot (725) traverses a cross-section of the rectangular shelf (200) from the shelf second side (260) to the second circular screwdriver holding aperture (720).

In some embodiments, a linear slot (730) is located on the shelf top surface (210) between the first circular screwdriver holding aperture (710) and the second circular screwdriver holding aperture (720). In some embodiments, the linear slot (730) traverses a cross-section of the rectangular shelf (200) from the shelf top surface (210) to the shelf bottom surface (220).

In some embodiments, a plurality of holes (740) is located on the shelf top surface (210) close to the anterior end. In some embodiments, the hole (740) traverses a cross-section of the rectangular shelf (200) from the shelf top surface (210) to the shelf bottom surface (220).

In some embodiment, the system (100) comprises a step ladder (110). In some embodiments, the system (100) comprises a folding ladder. In some embodiments, the system (100) comprises a collapsible ladder. In some embodiments, the system (100) comprises an extension ladder. In some embodiments, the system (100) comprises a ladder. In some embodiments, the system (100) comprises a telescoping ladder. In some embodiments, the system (100) comprises a platform ladder. In some embodiments, the system (100) comprises a step stool. In some embodiments, the system (100) comprises a multi-purpose ladder.

In some embodiments, Plane A (400) and Plane B (410) are parallel. In some embodiments, Plane C (420) and Plane D (430) are parallel. In some embodiments, Plane E (440) is perpendicular to Plane A (400) and Plane B (410). In some embodiments, Plane E (440) is perpendicular to Plane C (420) and Plane D (430).

As used herein, the term "about" refers to plus or minus 10% of the referenced number. For example, an embodiment wherein the shelf is about 10 inches in length includes a shelf that is between 9 and 11 inches in length.

The disclosures of the following U.S. Patents are incorporated in their entirety by reference herein. U.S. Pat. No. D 340,291; U.S. Patent Pub. No. 2006/0137937; U.S. Patent Pub. No. 2001/0052437; U.S. Pat. No. 8,033,362; U.S. Pat. No. 7,270,307; U.S. Pat. No. 7,032,711; U.S. Pat. No. 6,341,666; U.S. Pat. No. 5,058,707; U.S. Pat. No 4,949,925; and U.S. Pat. No. 2,308,180.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A ladder shelf system (100) for adding a generally planar rectangular shelf (200) proximal to a top of a step ladder (110), wherein said system (100) comprises:

(a) the generally planar rectangular shelf (200) having a shelf top surface (210), a shelf bottom surface (220), a shelf anterior end (230), a shelf posterior end (240), a shelf first side (250), and a shelf second side (260), wherein the rectangular shelf (200) is generally rigid;

(b) a step engagement member (300) disposed on the shelf top surface (210), wherein the step engagement member (300) comprises a step engagement member top surface (310), a step engagement member bottom surface (320), a step engagement member anterior side (330), a step engagement member posterior side (340), a step engagement member first side (350), and a step engagement member second side (360), wherein the step engagement member posterior side (340) is disposed flush with the shelf posterior end (240), wherein the step engagement member (300) traverses the rectangular shelf (200) from the shelf first side (250) to the shelf second side (260), wherein the step engagement member top surface (310) lies on a plane, Plane A (400), parallel to a plane, Plane B (410), wherein the shelf top surface (210) lies upon Plane B (410), wherein the step engagement member (300) comprises a step engagement member depth (380) extending from about the step engagement member anterior side (330) to about the step engagement member posterior side (340), the step engagement member depth configured to be equivalent to a depth of a top step interior cavity extending from about a top step anterior internal edge (126) to about a top step posterior internal edge (128), wherein the step engagement member (300) is adapted to fit inside the top step interior cavity (122);

wherein a step engagement member height (370) extends from the step engagement member top surface (310) to the step engagement member bottom surface (320) and is adapted to position the rectangular shelf (200) horizontally in a generally level manner when the shelf bottom surface (220) is disposed on a step ladder horizontal support (130) when the shelf engagement member (300) is disposed in the top step interior cavity (122);

(c) a generally planar rectangular non-slip pad (500) centrally disposed on the shelf top surface (210);

(d) a locking lever (600) disposed proximal to the shelf posterior end (240), wherein the locking lever (600) comprises a general shape of a "U" having a first leg (610) disposed thereon with a first leg terminating end (612), a second leg (620) disposed thereon with a second leg terminating end (622), and a horizontal cross member (630), wherein the first leg terminating end (612) is pivotally disposed on the shelf first side (250) proximal to the shelf posterior end (240), wherein the second leg terminating end (622) is pivotally disposed on the shelf second side (260) proximal to the shelf posterior end (240), wherein the locking lever (600) comprises a first clamping member (640) disposed at an intersection of the first leg (610) and a horizontal cross member first side (632) of the horizontal cross member (630), wherein the locking lever (600) comprises a second clamping member (650) disposed at an intersection of the second leg (620) and a horizontal cross member second side (634) of the horizontal cross member (630), wherein the first clamping member (640) is disposed at a perpendicular angle to the first leg (610), wherein the first clamping member (640) lies on a same plane, Plane C (420), as the first leg (610), wherein the first clamping member (640) extends out and away from the horizontal cross member (630), wherein the second clamping member (650) is disposed at a perpendicular angle to the second leg (620), wherein the second clamping member (650) lies on a same plane, Plane D (430), as the second leg (620), wherein the second clamping member (650) extends out and away from the horizontal cross member (630), wherein the locking lever is moveable between a first unlocked position and a second locked position, wherein the first clamping member (640) and the second clamping member (650) lie on a plane, Plane E (440), perpendicular to the shelf top surface (210) and said plane B when in the first unlocked position, and wherein the first clamping member (640) and the second clamping member (650) lie on said Plane A (410) when in the second locked position; and (e) a recess (700) disposed in the shelf top surface (210) midway between the shelf first side (250) and the shelf second side (260) proximal to the shelf posterior end (240), wherein the recess (700) lies beneath a horizontal cross member midpoint (636) of the horizontal cross member (630) when the horizontal cross member (630) is in the first unlocked position;

wherein the shelf bottom surface (220) is configured to be positioned on the step ladder horizontal support (130) as the step engagement member (300) is disposed in the top step interior cavity (122), wherein the locking lever (600) is configured to be moved to the second locked position which is configured to position the first clamping member (640) and the second clamping member (650) on an exterior top step top surface (124), wherein the rectangular shelf (200) is configured to be on the step ladder horizontal support (130) in a generally level position.

2. The system (100) of claim 1, wherein a first circular screwdriver holding aperture (710) is disposed on the shelf top surface (210) proximal to the shelf anterior end (230) and the shelf first side (250), wherein the first circular screwdriver holding aperture (710) traverses the rectangular shelf (200) from the shelf top surface (210) to the shelf bottom surface (220), wherein a second circular screwdriver holding aperture (720) is disposed on the shelf top surface (210) proximal to the shelf anterior end (230) and the shelf second side (260), wherein the second circular screwdriver holding aperture (720) traverses the rectangular shelf (200) from the shelf top surface (210) to the shelf bottom surface (220).

3. The system (100) of claim 2, wherein a first slot (715) is disposed on the shelf first side (250) proximal to the shelf anterior end (230), wherein the first slot (715) traverses the rectangular shelf (200) from the shelf first side (250) to the first circular screwdriver holding aperture (710), wherein a second slot (725) is disposed on the shelf second side (260) proximal to the shelf anterior end (230), wherein the second slot (725) traverses the rectangular shelf (200) from the shelf second side (260) to the second circular screwdriver holding aperture (720).

4. The system (100) of claim 2, wherein a linear slot (730) is disposed on the shelf top surface (210) between the first circular screwdriver holding aperture (710) and the second circular screwdriver holding aperture (720), wherein the linear slot (730) traverses the rectangular shelf (200) from the shelf top surface (210) to the shelf bottom surface (220).

5. The system (100) of claim 1, wherein a plurality of holes (740) is disposed on the shelf top surface (210) proximal to the shelf anterior end, wherein the plurality of holes (740) traverses the rectangular shelf (200) from the shelf top surface (210) to the shelf bottom surface (220).

* * * * *